US011125522B2

(12) United States Patent
Bies et al.

(10) Patent No.: US 11,125,522 B2
(45) Date of Patent: Sep. 21, 2021

(54) TEST GUN BARREL EXTENSION JOINT

(71) Applicant: BAE Systems Land & Armaments L.P., Arlington, VA (US)

(72) Inventors: Charles M. Bies, Andover, MN (US); Brian J. Isle, Brooklyn Park, MN (US); Scott A. Miller, Anoka, MN (US); Lee C. Semmerling, Shoreview, MN (US); Michael J. Hermanson, Andover, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 123 days.

(21) Appl. No.: 16/691,146

(22) Filed: Nov. 21, 2019

(65) Prior Publication Data

US 2021/0156637 A1 May 27, 2021

(51) Int. Cl.
*F41A 21/00* (2006.01)
*F41A 21/02* (2006.01)
*F41A 21/48* (2006.01)

(52) U.S. Cl.
CPC ..... *F41A 21/02* (2013.01); *F41A 21/482* (2013.01)

(58) Field of Classification Search
CPC ..... F41A 21/02; F41A 21/482; F41A 21/04; F41A 21/00; F41A 21/20
USPC ..... 89/16, 14.7, 14.8
See application file for complete search history.

(56) References Cited

U.S. PATENT DOCUMENTS

| | | | | |
|---|---|---|---|---|
| 2,990,342 | A * | 6/1961 | Sullivan | C25D 11/04 205/131 |
| 3,550,502 | A * | 12/1970 | Keith | F41A 21/02 89/16 |
| 3,996,916 | A * | 12/1976 | Koehn | F41A 21/00 124/72 |
| 5,123,194 | A * | 6/1992 | Mason | F41A 3/86 42/75.02 |
| 6,571,676 | B1 * | 6/2003 | Folsom | F41A 3/74 42/75.02 |
| 9,366,499 | B2 * | 6/2016 | Maeda | F41B 11/60 |
| 9,662,740 | B2 * | 5/2017 | Sutherlin | H05B 6/10 |
| 10,118,259 | B1 * | 11/2018 | Fonte | B21C 23/085 |
| 10,782,080 | B1 * | 9/2020 | Mitchell | F41A 11/02 |
| 2014/0007481 | A1 * | 1/2014 | Tresserras Torre | F41A 21/325 42/76.1 |
| 2019/0226786 | A1 * | 7/2019 | Sloan | F41A 21/28 |

* cited by examiner

*Primary Examiner* — Michael D David
(74) *Attorney, Agent, or Firm* — Patterson Thuente Pedersen, P.A.

(57) ABSTRACT

Disclosed herein is a test gun barrel for use with a long range projectile testing system. The test gun barrel comprising a main gun barrel and a gun barrel extension. The main gun barrel and gun barrel extension each include a joint end having aligning cylinders and bores to properly align the main gun barrel to the extension prior to engaging threaded coupling. A seal capable of being inspected is made once main gun barrel is fully coupled to gun barrel extension.

20 Claims, 5 Drawing Sheets

TEST GUN BARREL EXTENSION JOINT

TECHNICAL FIELD

The present invention generally relates to projectile testing and more specifically to a gun barrel extension.

BACKGROUND

An important research objective in modern military weapon design is increasing muzzle velocity for the projectiles being fired through a gun barrel. Higher muzzle velocities lead to projectiles having increased range, flatter trajectories, higher impact energies, and greater accuracy.

One conventional technique for attaining higher muzzle velocity is to increase the length of the gun barrel. An increased gun barrel length increases the duration that the projectile is acted on by the propellant gas pressure and, therefore, the projectile can reach higher muzzle velocities. Research directed to increased gun barrel length of large caliber guns often involves transportation of testing platforms, including prototype gun barrels, to different test sites. Transportation of extended-length gun barrels can present significant logistical problems, especially under short timelines.

Extended-length gun barrels can exceed 10 meters in length and are difficult or impossible to transport by air. Thus, extended-length gun barrels are often required to be transported by land or sea, significantly increasing the cost, complexity, and timing of shipping. Conventional extended-length gun barrels are often shipped in 2 pieces for this reason.

Once a 2-piece extended-length gun barrel reaches its destination, it is assembled for use at that destination. Conventional 2-part extended-length gun barrels require joints that operate as a seamless gun barrel in order to address high range projectile firing dynamics. For this reason, conventional extended-length gun barrels cannot be disassembled as they require an irreversible weldment or other coupling means. This limitation presents a significant obstacle for extended-length gun barrels that need to be used and transported more than once, as they are in a research setting.

SUMMARY OF THE INVENTION

Disclosed herein are embodiments of a test gun barrel for use with a long range projectile testing system. In particular, the test gun barrel includes a removable extension that extends the length of the barrel. The test gun barrel can include a main gun barrel and a gun barrel extension that are removably coupleable at a joint. The main gun barrel includes a main barrel joint end which includes a first pilot cylinder, a second pilot cylinder, an external threaded portion, and a sealing face. The test gun barrel also includes a gun barrel extension which includes an extension joint end. The extension joint end further includes a first pilot bore, a second pilot bore, an internal threaded portion, and sealing channel configured to receive a flexible seal. The first pilot cylinder is configured to slidably engage with the internal threaded portion and the second pilot bore. The first pilot bore is configured to slidably engage with the external threaded portion and the second pilot cylinder. The internal threaded portion is configured to rotatably engage with the external threaded portion. The sealing face is configured to sealably engage with the flexible seal.

In embodiments, the first pilot cylinder and the second pilot bore include a diameter substantially similar to a minor diameter of the internal threaded portion. Similarly, the first pilot bore and the second pilot cylinder include a diameter substantially similar to a major diameter of the external threaded portion.

The first pilot cylinder includes a length that is greater than the external threaded portion, and that length is greater than the internal threaded portion. The second pilot cylinder includes a length that is greater than the external threaded portion, and that length is greater than the internal threaded portion. The first pilot bore includes a length that is greater than the external threaded portion, and that length is greater than the internal threaded portion. The second pilot bore includes a length that is greater than the external threaded portion, and that length is greater than the internal threaded portion.

Further, the sealing face can be arranged orthogonal the axis of the main gun barrel, or at an angle thereto. Embodiments can also include a circular array of seal integrity access apertures arranged proximate the sealing channel within the extension joint end. The extension joint end can also include one or more set screw apertures arranged proximate the first pilot bore.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
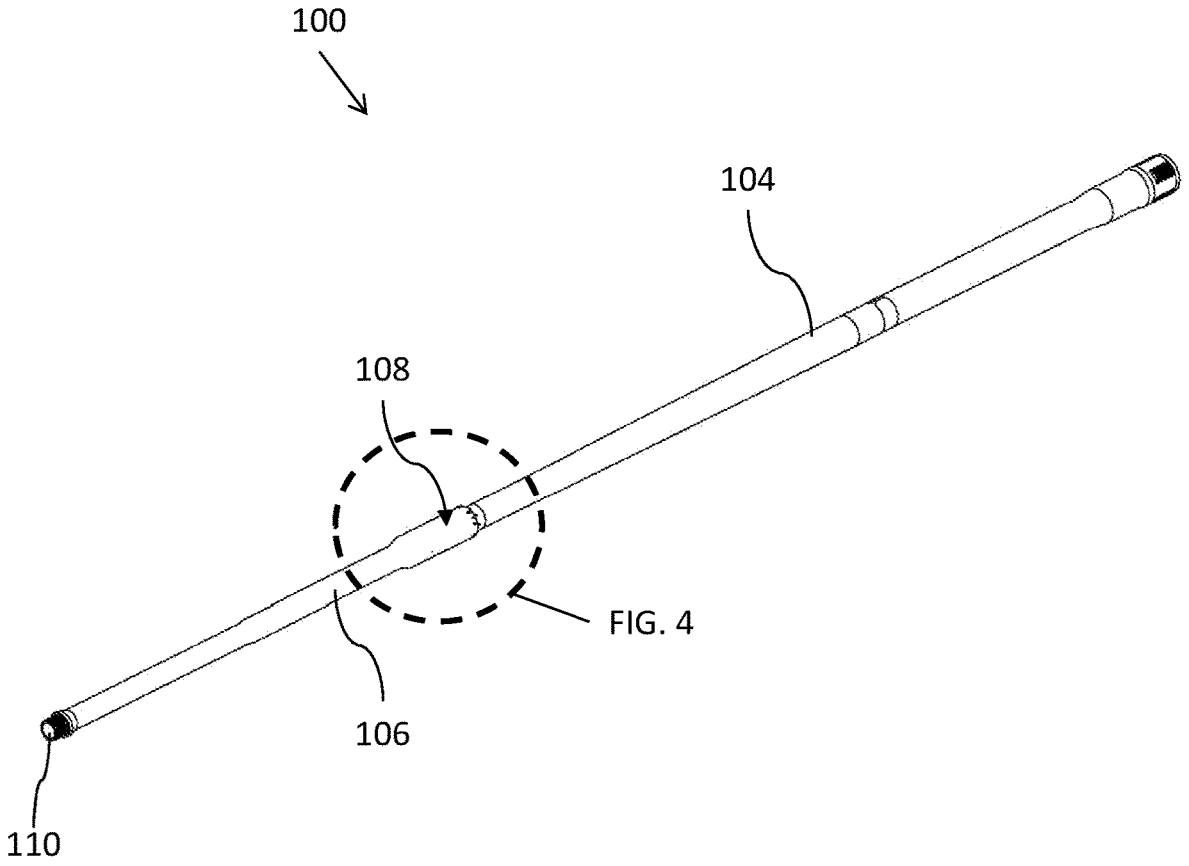
FIG. 1 is an isometric view of a gun barrel, according to embodiments disclosed herein.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Described herein are devices, systems and methods for reversibly extending a gun barrel. In particular, the extendable gun barrel is configured to provide reversible extension of a barrel for use in long range projectile testing systems. The gun barrel includes a joint configured to couple a main gun barrel portion to an extension portion. The joint includes having guiding portions to aid in field assembly as well as inspection capabilities critical to a non-permanent barrel joint.

Referring now to FIG. 1, a test gun barrel extension system 100 includes a main gun barrel 104, a gun barrel extension 106, and an extension joint 108. In embodiments, main gun barrel 104 couples to gun barrel extension 106 via extension joint 108. When in an assembled position, test gun barrel extension system 100 includes a bore 110. Bore 110 is configured to provide guidance and an acceleration structure for a projectile. Embodiments of test gun barrel extension system 100 can be made of steel or other material suitable for withstanding the stresses of long range projectile firing dynamics.

Figure 2A:
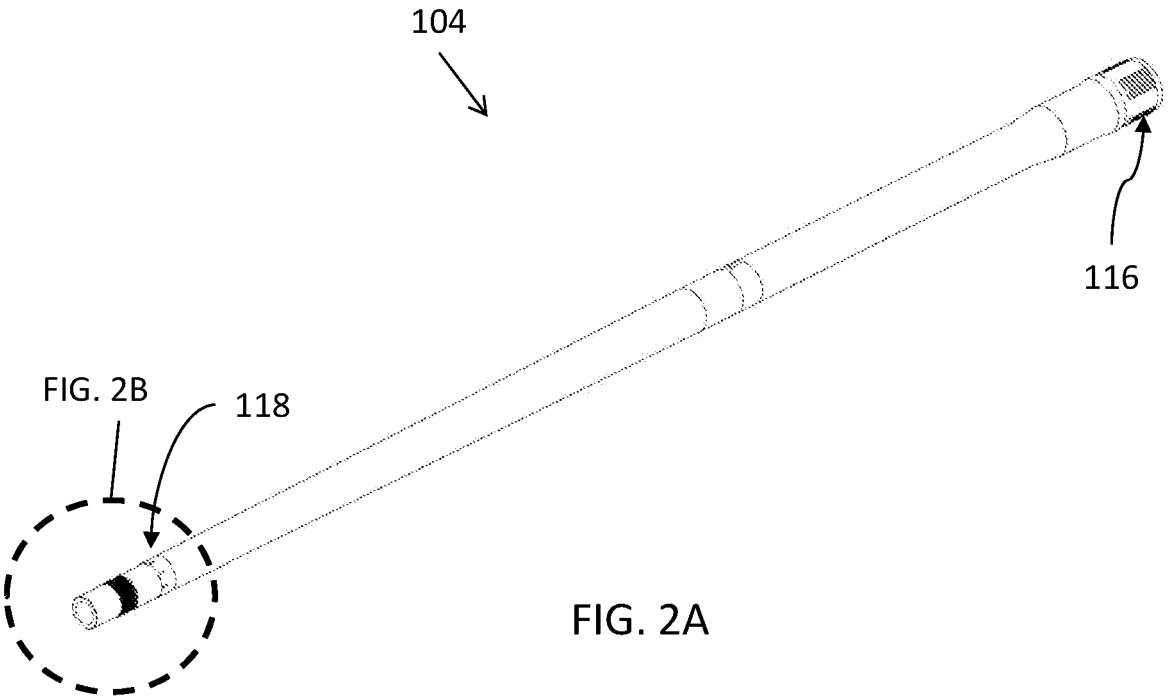
FIG. 2A is an isometric view of a main gun barrel portion of the gun barrel of FIG. 1, according to embodiments disclosed herein.
Figure 2B:
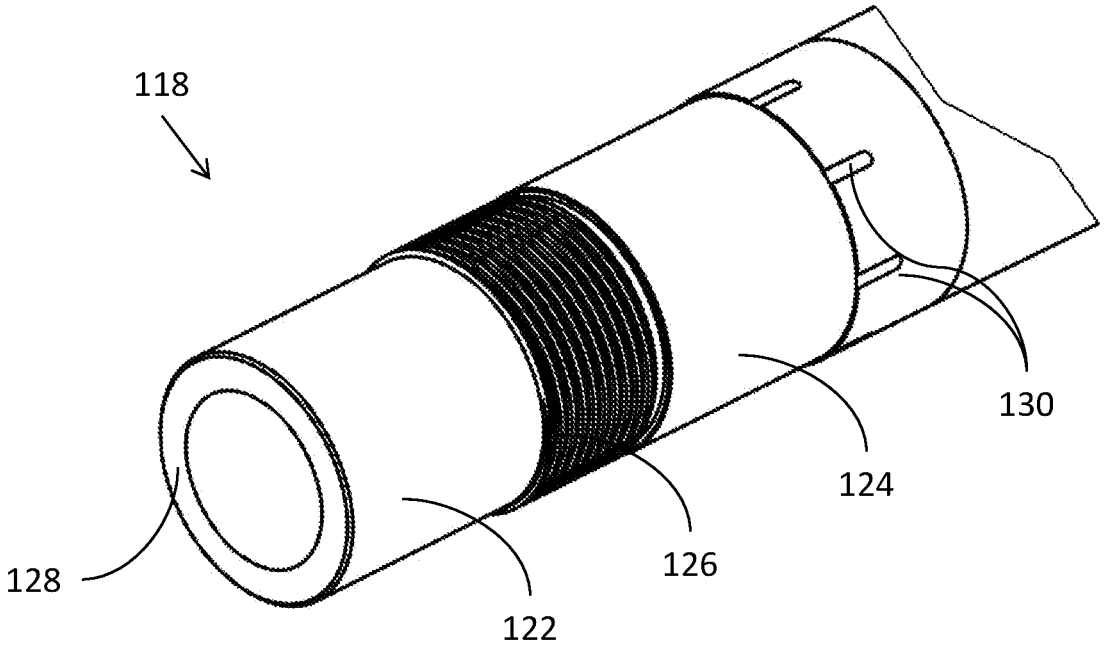
FIG. 2B is a close-up, isometric view of a joint end of a main gun barrel portion of the gun barrel of FIG. 1, according to embodiments disclosed herein.

Referring now to FIGS. 2A and 2B, main gun barrel 104 includes a muzzle end 116 and a main barrel joint end 118. Muzzle end 116 is arranged opposite joint end 118. Muzzle end 116 is configured to manage projectile exit exhaust and waste energy management. Main barrel joint end 118 is configured to provide the male portion of extension joint 108. Main barrel joint end 118, and referring to FIG. 2B, includes a first pilot cylinder 122, a second pilot cylinder 124, and a threaded portion 126.

Threaded portion 126 includes an external thread. The thread designation of threaded portion 126 can be commensurate with the diameter and strength requirements of test gun barrel extension system 100. Because threaded portion 126 can serve as an alignment bearing surface, a Stub ACME-type thread designation is preferred. For example, the thread designation could be 9.25 inches-2 Stub ACME-4g, or other suitable thread designation.

First pilot cylinder 122 includes a diameter substantially similar to the minor diameter of threaded portion 126, i.e., the thread root diameter. Second pilot cylinder 124 includes a diameter substantially similar to the major diameter of threaded portion 126, i.e., the thread crest diameter. In embodiments, first pilot cylinder 122 includes a length that is greater than threaded portion 126. Second pilot cylinder 124 can also include a length that is greater than threaded portion 126. In alternative embodiments, diameters and lengths of first pilot cylinder 122, second pilot cylinder 124, and threaded portion 126 can vary.

Main barrel joint end 118 can also include a sealing face 128 and a circular array of wrench grip grooves 130. Sealing face 128 is arranged orthogonally to bore 110. In alternative embodiments, sealing face 128 is can be arranged at an offset angle from orthogonal to bore 110. Sealing face 128 is configured to include a surface finish commensurate with providing a fluidly impenetrable coupling when joined with a corresponding seal component. Circular array of wrench grip grooves 130 are configured to provide a slip resistant engagement with tightening and loosening tools, such as a wrench.

Figure 3A:
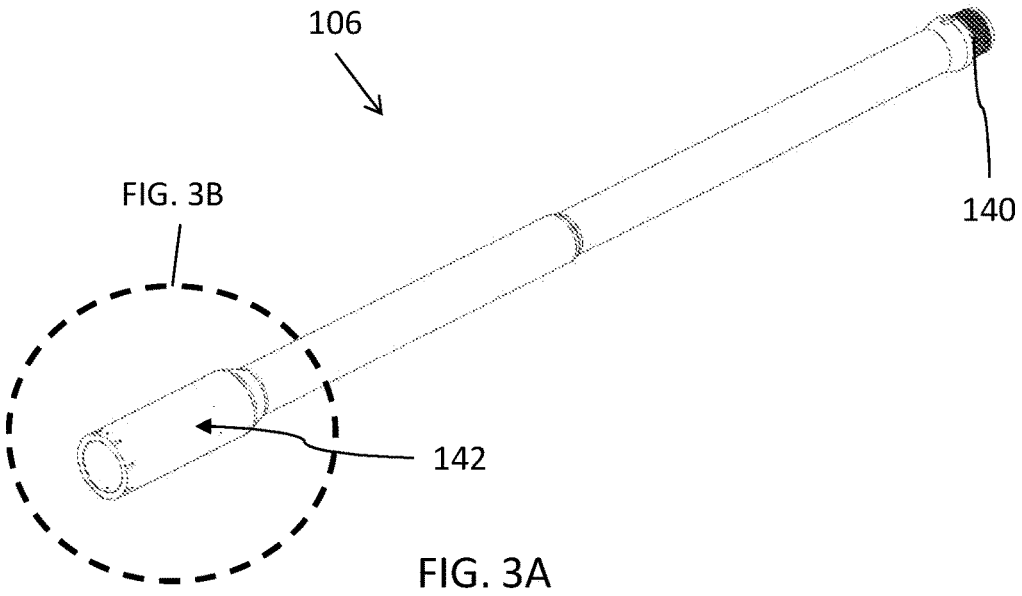
FIG. 3A is an isometric view of a gun barrel extension portion of the gun barrel of FIG. 1, according to embodiments disclosed herein.
Figure 3B:
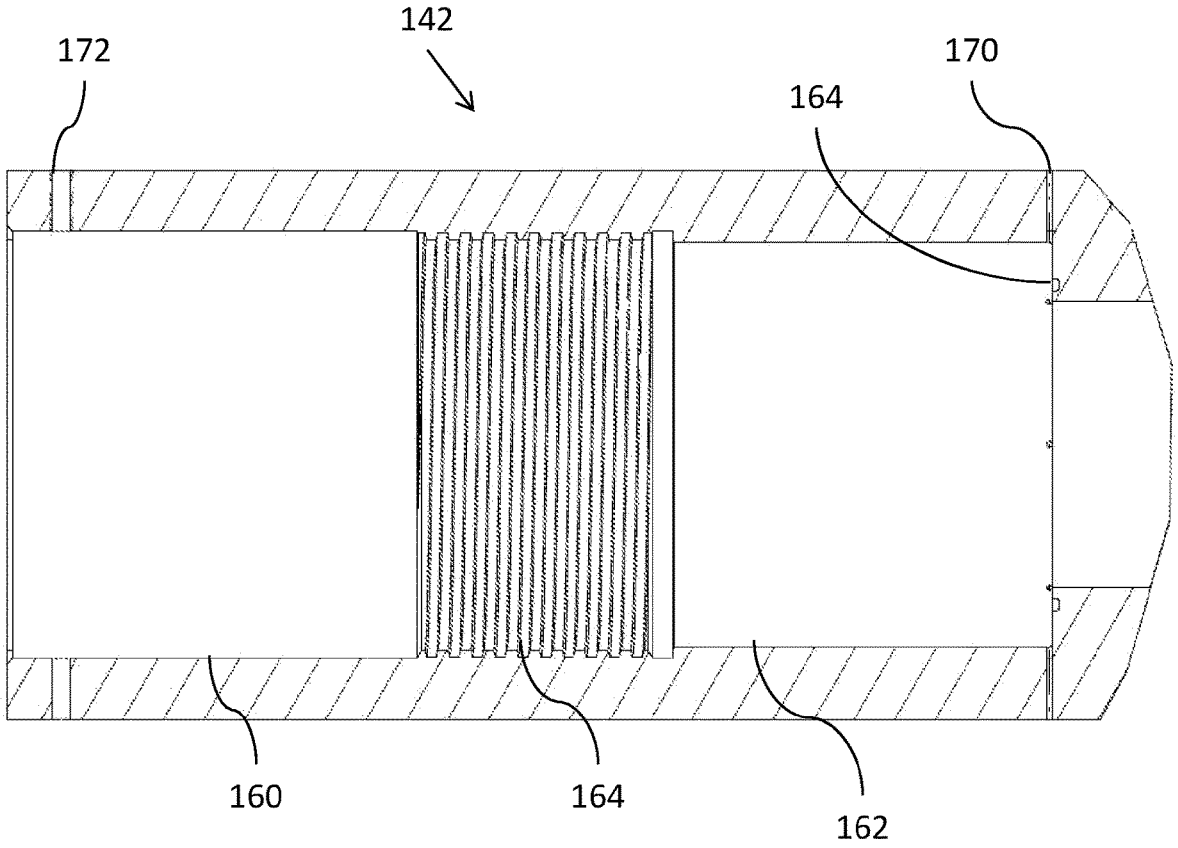
FIG. 3B is a close-up, isometric view of a joint end of a gun barrel extension portion of the gun barrel of FIG. 1, according to embodiments disclosed herein.
Figure 3C:
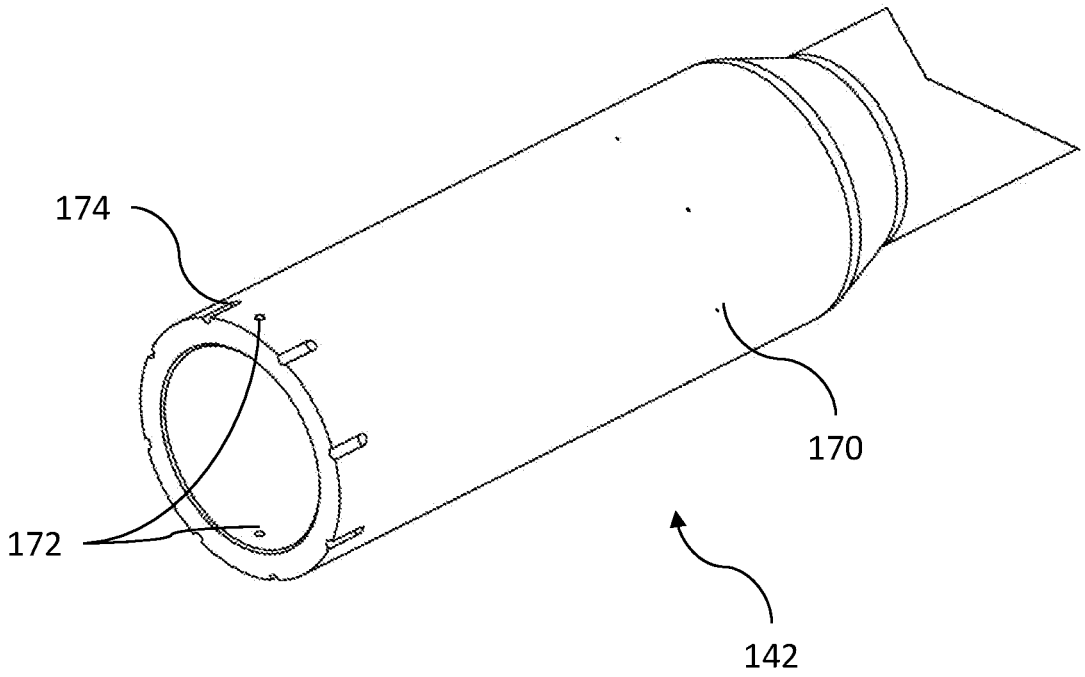
FIG. 3C is a close-up, cross-section view of a joint end of a gun barrel extension portion of the gun barrel of FIG. 1, according to embodiments disclosed herein.

Referring now to FIGS. 3A-3C, gun barrel extension 106 includes a gun coupling end 140 and an extension joint end 142. Gun coupling end 140 is arranged opposite extension joint end 142. Gun coupling end 140 is configured to couple to a long range projectile testing firing chamber via threaded coupling. Extension joint end 142 is configured to provide the female portion of extension joint 108. Extension joint end 142, and referring to FIGS. 3B and 3C, includes a first pilot bore 160, a second pilot bore 162, and a threaded portion 164.

Threaded portion 164 includes an internal thread. The thread designation of threaded portion 164 can be commensurate with the diameter and strength requirements of test gun barrel extension system 100. Threaded portion 164 thread designation corresponds to the thread designation of threaded portion 126. Because threaded portion 164 can serve as an alignment bearing surface, a Stub ACME-type thread designation is preferred. For example, the thread designation could be 9.25 inches-2 Stub ACME-4g, or other suitable thread designation.

First pilot bore 160 includes a diameter substantially similar to the major diameter of threaded portion 164, i.e. the thread root diameter. Second pilot bore 162 includes a diameter substantially similar to the minor diameter of threaded portion 164, i.e., the thread crest diameter. In embodiments, first pilot bore 160 includes a length that is greater than threaded portion 164. Second pilot bore 162 can also include a length that is greater than threaded portion 164. In alternative embodiments, diameters and lengths of first pilot bore 160, second pilot bore 162, and threaded portion 164 can vary.

Extension joint end 142 can also include a sealing channel 166 and a circular array of seal integrity access apertures 170. Sealing channel 166 is configured to receive a flexible seal component, such as a rubber o-ring, or other suitable flexible seal component. Circular array of seal integrity access apertures 170 are arranged around the circumference of extension joint end 142 a sealing channel 166. Each seal integrity access aperture 170 can be a through hole such that access to the proximate area around sealing channel 166 can be gained from outside extension joint end 142. Extension joint end 142 further includes one or more set screw apertures 172 and a circular array of wrench grip grooves 174. The one or more set screw apertures 172 are configured to provide set screw fixation between main barrel joint end 118 and extension joint end 142 when main gun barrel 104 and gun barrel extension 106 are coupled together. Circular array of wrench grip grooves 174 are configured to provide a slip resistant engagement with tightening and loosening tools, such as a wrench.

Figure 4:
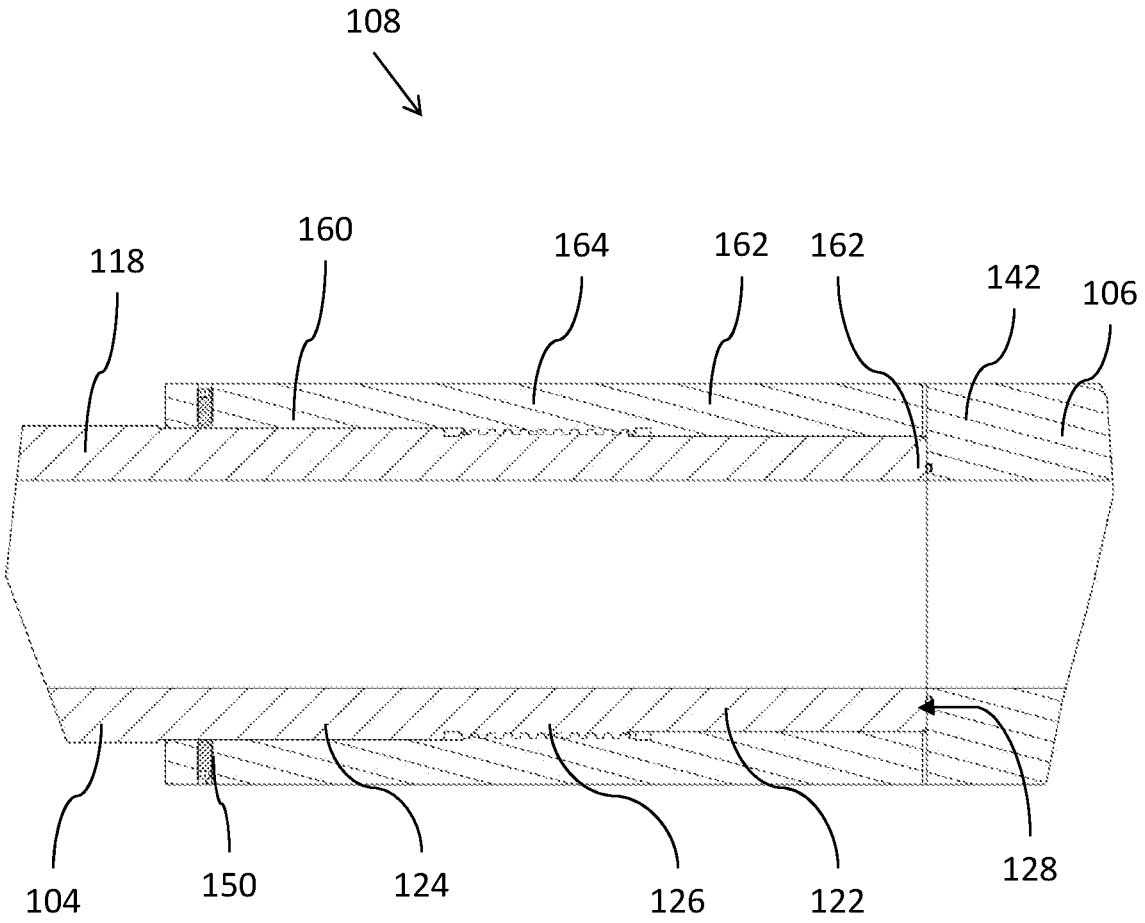
FIG. 4 is a close-up, cross-section view of a joint portion of the gun barrel of the gun barrel of FIG. 1, according to embodiments disclosed herein.

In use and now referring now to FIG. 4, extension joint 108 includes the coupling of main gun barrel 104 and gun barrel extension 106 at main barrel joint end 118 and extension joint end 142, respectively. During coupling, main barrel joint end 118 is inserted into extension joint end 142. During insertion, first pilot cylinder 122 first makes contact with the thread crests of threaded portion 164 and begins to align main barrel joint end 118 with extension joint end 142. As first pilot cylinder 122 continues to slide past threaded portion 164, the thread crests of threaded portion 126 begin to make contact with first pilot bore 160 of extension joint end 142. Similarly, slidable contact between first pilot bore 160 and the thread crests of threaded portion 126 aids in further aligning main barrel joint end 118 with extension joint end 142.

Once main barrel joint end 118 is inserted into extension joint end 142 such that first pilot cylinder 122 and first pilot bore 160 extend past threaded portion 164 and threaded portion 126, respectively, first pilot cylinder 122 begins to make slidable contact with second pilot bore 162. Similarly, first pilot bore 160 begins to make slidable contact with second pilot cylinder 124. Because the bearing fitment between first pilot cylinder 122 and second pilot bore 162 and the bearing fitment between first pilot bore 160 and second pilot cylinder 124 is tight, main barrel joint end 118 and extension joint end 142 are closely aligned.

Main barrel joint end 118 continues to be inserted into extension joint end 142 until threaded portion 126 engages with threaded portion 164. At this point, coupling of main gun barrel 104 and gun barrel extension 106 proceed by threaded portion 126 rotatably engaging with threaded portion 164. Main gun barrel joint end 118 is rotated with respect to extension joint end 142, via wrench grip grooves 130 and wrench grip grooves 174, until sealing face 128 contacts the flexible seal component within sealing channel 166. Main gun barrel joint end 118 is rotatably tightened to extension joint end 142, via wrench grip grooves 130 and wrench grip grooves 174, such that a sufficient sealable engagement is made between sealing face 128 and the flexible seal component within sealing channel 166. Set screw apertures 172 and set screws are then used to provide rotational friction between main barrel joint end 118 and extension joint end 142.

When main gun barrel 102 and gun barrel extension 106 are coupled together, the circular array of seal integrity access apertures 170 can be used to inspect the integrity of the sealed joint between sealing face 128 and the flexible seal component received by sealing channel 166. Further, circular array of seal integrity access apertures 170 can be used to inspect the sealed joint after each firing.

Prior to transportation of test gun barrel extension system 100, main gun barrel and extension joint end 142 can be decoupled by removing the set screws and counter-rotating main barrel joint end 118 with respect to extension joint end 142.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

The invention claimed is:

1. A test gun barrel for use with a long range projectile testing system, the test gun barrel comprising:

a main gun barrel, the main gun barrel including a main barrel joint end, the main barrel joint end further including a first pilot cylinder, a second pilot cylinder, an external threaded portion, and a sealing face;

a gun barrel extension, the gun barrel extension including an extension joint end, the extension joint end further including a first pilot bore, a second pilot bore, an internal threaded portion, and sealing channel configured to receive a flexible seal;

wherein the first pilot cylinder is configured to slidably engage with the internal threaded portion and the second pilot bore, the first pilot bore being configured to slidably engage with the external threaded portion and the second pilot cylinder, the internal threaded portion configured to rotatably engage with the external threaded portion, and the sealing face configured to sealably engage with the flexible seal.

2. The test gun barrel of claim 1, wherein the first pilot cylinder and the second pilot bore include a diameter substantially similar to a minor diameter of the internal threaded portion.

3. The test gun barrel of claim 1, wherein the first pilot bore and the second pilot cylinder include a diameter substantially similar to a major diameter of the external threaded portion.

4. The test gun barrel of claim 1, wherein the first pilot cylinder includes a length that is greater than the external threaded portion, and that length is greater than the internal threaded portion.

5. The test gun barrel of claim 1, wherein the second pilot cylinder includes a length that is greater than the external threaded portion, and that length is greater than the internal threaded portion.

6. The test gun barrel of claim 1, wherein the first pilot bore includes a length that is greater than the external threaded portion, and that length is greater than the internal threaded portion.

7. The test gun barrel of claim 1, wherein the second pilot bore includes a length that is greater than the external threaded portion, and that length is greater than the internal threaded portion.

8. The test gun barrel of claim 1, wherein the sealing face is arranged orthogonally the axis of the main gun barrel.

9. The test gun barrel of claim 1, wherein the extension joint end includes a circular array of seal integrity access apertures arranged proximate the sealing channel.

10. The test gun barrel of claim 1, wherein the extension joint end includes one or more set screw apertures arranged proximate the first pilot bore.

11. A long range projectile testing system comprising:

a test gun base, the test gun base including an ignition chamber;

a test gun barrel coupleable to the ignition chamber, the test gun barrel including a test gun barrel, the test gun barrel comprising:

a main gun barrel, the main gun barrel including a main barrel joint end, the main barrel joint end further including a first pilot cylinder, a second pilot cylinder, an external threaded portion, and a sealing face;

a gun barrel extension, the gun barrel extension including an extension joint end, the extension joint end further including a first pilot bore, a second pilot bore, an internal threaded portion, and sealing channel configured to receive a flexible seal;

wherein the first pilot cylinder is configured to slidably engage with the internal threaded portion and the second pilot bore, the first pilot bore being configured to slidably engage with the external threaded portion and the second pilot cylinder, the internal threaded portion configured to rotatably engage with the external threaded portion, and the sealing face configured to sealably engage with the flexible seal.

12. The long range projectile testing system of claim 11, wherein the first pilot cylinder and the second pilot bore include a diameter substantially similar to a minor diameter of the internal threaded portion.

13. The long range projectile testing system of claim 11, wherein the first pilot bore and the second pilot cylinder include a diameter substantially similar to a major diameter of the external threaded portion.

14. The long range projectile testing system of claim 11, wherein the first pilot cylinder includes a length that is greater than the external threaded portion, and that length is greater than the internal threaded portion.

15. The long range projectile testing system of claim 11, wherein the second pilot cylinder includes a length that is greater than the external threaded portion, and that length is greater than the internal threaded portion.

16. The long range projectile testing system of claim 11, wherein the first pilot bore includes a length that is greater than the external threaded portion, and that length is greater than the internal threaded portion.

17. The long range projectile testing system of claim 11, wherein the second pilot bore includes a length that is greater than the external threaded portion, and that length is greater than the internal threaded portion.

18. The long range projectile testing system of claim 11, wherein the sealing face is arranged orthogonally the axis of the main gun barrel.

19. The long range projectile testing system of claim 11, wherein the extension joint end includes a circular array of seal integrity access apertures arranged proximate the sealing channel.

20. The long range projectile testing system of claim 11, wherein the extension joint end includes one or more set screw apertures arranged proximate the first pilot bore.

* * * * *